United States Patent [19]

Tomita

[11] 4,060,201

[45] Nov. 29, 1977

[54] SPRINKLER HEAD

[75] Inventor: Tomiichi Tomita, Tokyo, Japan

[73] Assignee: Sanwa Seiki Kabushiki Kaisha, Tokyo, Japan

[21] Appl. No.: 670,685

[22] Filed: Mar. 26, 1976

[30] Foreign Application Priority Data

Mar. 28, 1975 Japan ..... 50-36811

[51] Int. Cl.[2] ..... A62C 37/10

[52] U.S. Cl. ..... 239/553; 169/40; 169/42; 239/DIG. 1

[58] Field of Search ..... 169/37–42; 239/500, 504, 522, 524, 548, 552, DIG. 1, 553

[56] References Cited

U.S. PATENT DOCUMENTS

| | | | |
|---|---|---|---|
| 2,418,765 | 4/1947 | Freeman | 169/39 |
| 3,525,402 | 8/1970 | Hattori | 169/40 |
| 3,716,103 | 2/1973 | Tanaka et al. | 169/42 |

*Primary Examiner*—John J. Love
*Assistant Examiner*—Andres Kashnikow
*Attorney, Agent, or Firm*—Blanchard, Flynn, Thiel, Boutell & Tanis

[57] ABSTRACT

A sprinkler is provided with a plurality of sprinkling apertures having peripheral portions therein formed substantially perpendicularly to a floor surface over which the water is to be directed, thereby permitting more than a predetermined quantity of water to be sprinkled without specific directivity over the entire range of a predetermined area both under high and low hydraulic pressures.

5 Claims, 9 Drawing Figures

SPRINKLER HEAD

FIELD OF THE INVENTION

This invention relates to a sprinkler, more particularly to an improved sprinkler in which pressurized water impinges upon a deflector member, the surface of which is arranged substantially parallel to a floor surface over which the water is to be sprinkled. Further, there are provided on a slanted portion of a body of the sprinkler a plurality of apertures, the external peripheral wall portions of which are formed substantially perpendicular to the floor surface.

BACKGROUND OF THE INVENTION

Sprinklers which are mounted on the ceiling of a room so as to be responsive to an occurrence of fire, must meet various legal and safety requirements.

For example, it is legally required that more than a predetermined quantity of water be sprinkled at every section within 3 meters from the center of the sprinkler. In this case, it is required that an even and sufficient distribution of sprinkled water be obtained even in the presence of hydraulic pressure change in the range of $1kg/cm^2$ to $7kg/cm^2$.

Further, the minimum diameter of the sprinkling apertures is made such that the apertures do not clog during sprinkling.

With the conventional sprinkler which has sprinkling apertures of a larger diameter than those in the present invention, water under high pressure tends to be directively discharged without being atomized. Therefore, technically speaking, it is not a simple matter to sprinkle a sufficient quantity of water all over the floor or particular area within the range of 3 meters from the center of the sprinkler by eliminating the directivity.

Further, it is obvious that construction of a sprinkler satisfying the above requirements under higher pressure does not necessarily meet the requirements under lower pressure. Thus, many sprinkler products have been rejected after water sprinkling distribution tests have been carried out.

For example, in a conventional sprinkler, a spiral groove is provided inside the sprinkling aperture to spurt out water after twisting same for eliminating the directivity thereof. In this case, however, there is a shortcoming in that the diameter of the water sprinkling range is decreased if the water pressure is increased to an extent that the legal requirement cannot be met, although meeting the requirement under lower pressure.

Accordingly, an object of the present invention is to provide a sprinkler in which more than a predetermined quantity of water can be sprinkled over the entire range of a predetermined coverage both under high and low pressures in order to overcome the aforementioned disadvantages associated with the conventional sprinklers according to the prior art.

These and other objects and features of the present invention will be apparent to those skilled in the art from the following detailed description and the appended claims.

Essentially, according to the present invention, there is provided an improved sprinkler comprising a funnel-shaped housing member which is provided with a threaded portion at the upper internal periphery thereof and a slanted surface having a plurality of sprinkling apertures, a disc-shaped cover member provided at its central portion with a penstock and at the lower external periphery of said disc-shaped member with another threaded portion, a deflector member provided at the top thereof with a recessed portion and at the lower surface thereof with a pair of legs, a receiving plate disposed in the recessed portion of said deflector member provided with an adjusting pin, and a support member having a disc and a pair of arms welded to one surface of said disc, the improvement wherein said sprinkling apertures are formed with their wall portions substantially peripendicular to a floor of a building.

BRIEF DESCRIPTION OF THE DRAWINGS

This invention will now be more particularly described with reference to the accompanying drawings in which.

DETAILED DESCRIPTION

Figure 1:
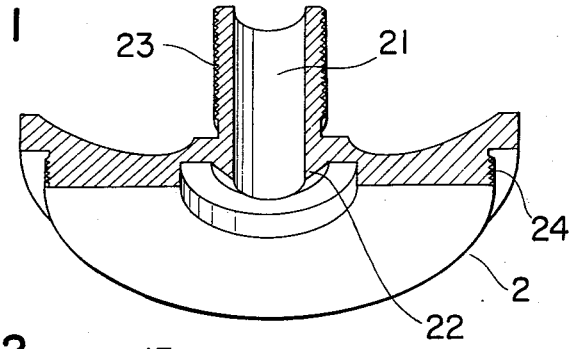
FIG. 1 is a perspective view of a cover member of the sprinkler embodying this invention.
Figure 2:
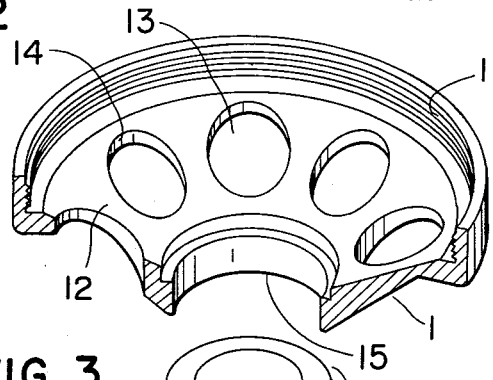
FIG. 2 is a perspective view of a funnel-shaped body of the sprinkler.
Figure 3:
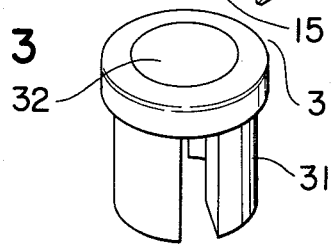
FIG. 3 is a perspective view of a deflector member of the sprinkler.
Figure 4:
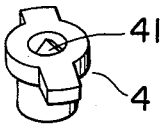
FIG. 4 is a perspective view of an adjusting member used in association with the deflector member.
Figure 5:
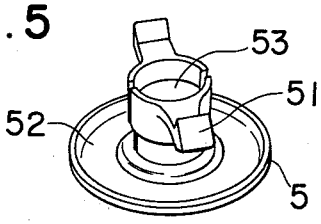
FIG. 5 is a perspective view of a support member of the sprinkler.

Referring now to the drawings, the numeral 1 indicates a housing member of the sprinkler having a funnel-like shape and provided at an internal upper peripheral edge with a threaded portion 11 for a screwed connection with a cover member 2. Further, the member 1 is provided with a plurality of sprinkling apertures 13 at a substantially thick and slanted funnel portion 12 of the housing member 1.

All of the sprinkling apertures 13 have substantially the same configuration which gives a circular or elliptical appearance when projected onto a plane perpendicular to the axis of the housing member 1.

As a result thereof, a peripheral wall 14 of the sprinkling aperture 13 constitutes a wall surface substantially perpendicular to the floor surface over which the water is to be sprinkled and the peripheral wall 14 acts to cause the water impinging thereon under high pressure to flow downwardly along the surface thereof.

However, it is not necessary to form the entire wall surface of the sprinkling aperture 13 perpendicularly to the floor surface, but it is particularly necessary to dispose the outer portion **14*a* (FIG. 8) of the peripheral wall 14 away from the center of the housing member 1, namely, that portion of the wall 14** onto which the water under high pressure impinges directly in a perpendicular direction to the floor surface. The perpendicular disposition of that portion is sufficient to achieve the object of the present invention.

Further, according to this invention, a central bore 15 is provided at the center of the housing member 1 so that legs 31 of a deflector member 3 can be fitted into the bore 15.

The disc-shaped cover member 2 is fitted into the housing member 1 on the top side thereof and a penstock 21 is protrudingly provided at the top side of the cover member 2 to supply water under high pressure to the housing member 1.

The port edge portion 22 of the penstock 21 opened at the plane of the cover member 2 is formed so that the longitudinal section thereof gives an acute angle at the protrusion. The penstock 21 is provided at its external periphery with a threaded portion 23 for connection with a feed pipe or the like pipe buried in the ceiling.

The cover member 2 is provided at its lower external periphery with another threaded portion 24 to couple with the thread 11 on the housing member 1.

As noted above, the numeral 3 indicates a deflector member having a disc-shape of a smaller diameter which is provided with a pair of legs 31 protruding downward from the underside thereof.

The legs 31 are arranged so as to have a size which permits same to be freely fitted into the central bore 15 of the housing member 1.

Since the deflector member 3 has a diameter larger than that of the central bore 15, the deflector member 3, per se, will not pass through the central bore 15 when the legs 31 are fitted into the latter.

Further, a receiving plate 32 made of a relatively soft metal such as copper is located in a recess formed at the center of the deflector member 3 so that when the port edge portion 22 of the penstock 21 bites firmly into the receiving plate 32 the water is not sprinkled, but the pressurized water in the penstock 21 is discharged into the housing member 1 when a gap is formed between the port edge portion 22 and the receiving plate 32.

Hereafter, the relationship between the positions of the deflector member 3 and the sprinkling apertures 13 will be discussed in detail.

As a result of a series of experiments conducted by the inventor, it has been found that a desirable sprinkling effect can be obtained when the lowermost portion of the inner edge of the sprinkling apertures 13 of the housing member 1 is arranged almost flush with the top plane of the deflector member 3, the surface of which is disposed substantially in parallel to the floor surface over which the water is to be sprinkled. That is to say, the deflector member 3 is preferably disposed so that the top surface thereof can be faintly seen above the lowermost edge of the sprinkling apertures 13 when viewed from the side of the sprinkler.

If the deflector member 3 is disposed at a level higher than the above-mentioned level, a sufficient deflective action cannot be achieved in the housing member 1, due to the fact that the internal volume of the space above the deflector member 3 becomes too small and as a result, the water remaining in the housing member 1 spouts out from the sprinkling apertures 13 in the form of bundles of water having a directivity without being fully atomized.

On the other hand, if the deflector member 3 is disposed at an excessively low level, the water is deflected therefrom in the lateral direction thus rendering the scattering thereof more difficult and reducing the diameter of the water sprinkling range.

In order to cause the port edge portion 22 to bite into the receiving plate 32, there is provided an adjusting member 4 having inside thereof an adjusting pin 41 which is movable upwardly or downwardly through screw action. The member 4 is located between the legs 31 of the reflector member 3 when the sprinkler is assembled.

Figure 6:
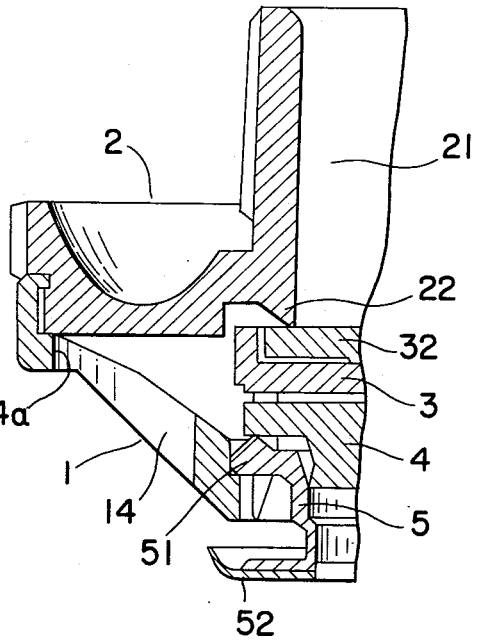
FIG. 6 is a partial sectional view of the sprinkler showing the assembled state thereof.
Figure 7:
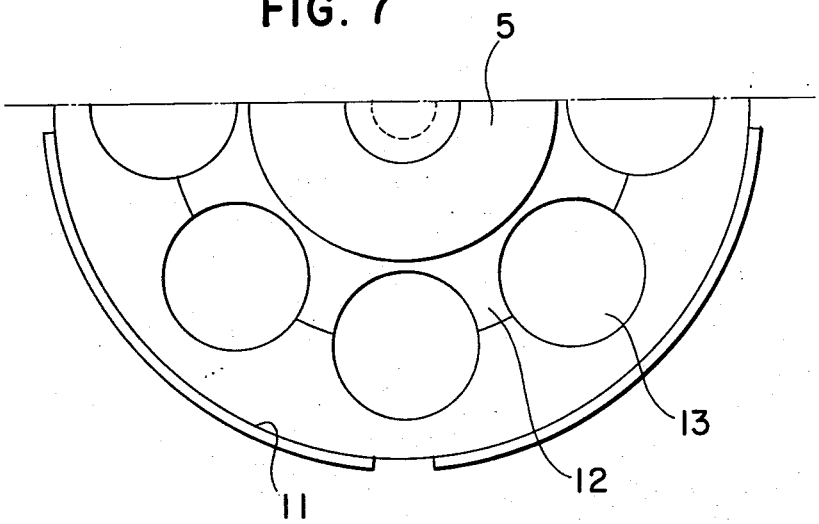
FIG. 7 is a bottom plan view of the sprinkler.

The numeral 5 indicates a supporting member having two arms 51 welded to a disc 52 by using a metal such as bismuth, which is fusible at a temperature of 75° C, and the arms 51 are adapted to engage with the inside edge of the central bore 15 of the housing member 1, as shown in FIG. 6.

Between the arms 51, a through-hole 53 is bored from the underside so that the adjusting pin 41 of the adjusting member 4 can be adjusted externally.

In operation, if the operation temperature rises due to a fire occurring in the vicinity of the sprinkler mounted on the ceiling as shown in FIG. 6, the base portion of the arms 51 of the supporting member 5 will melt and consequently, the disc 52 and the arms 51 will drop separately.

Accordingly, the adjusting member 4 also drops simultaneously through the central bore 15. At that moment, the legs 31 of the deflector member 3 drop through the central bore 15 and as a result, the receiving plate 32 is separated from the port edge portion 22, thus permitting the water under high pressure in the penstock 21 to be discharged into the housing member 1.

In this case, the hydraulic pressure can reach up to 7kg/cm$^2$. The water under such high pressure impinges upon the receiving plate 32 of the deflector member 3 placed directly below the penstock 21 and a portion of the water is deflected almost laterally, with the water deflected toward the space between the outermost round end and the innermost round end of the sprinkling aperture 13 being scattered farther outside the general range of the sprinkler.

Figure 8:
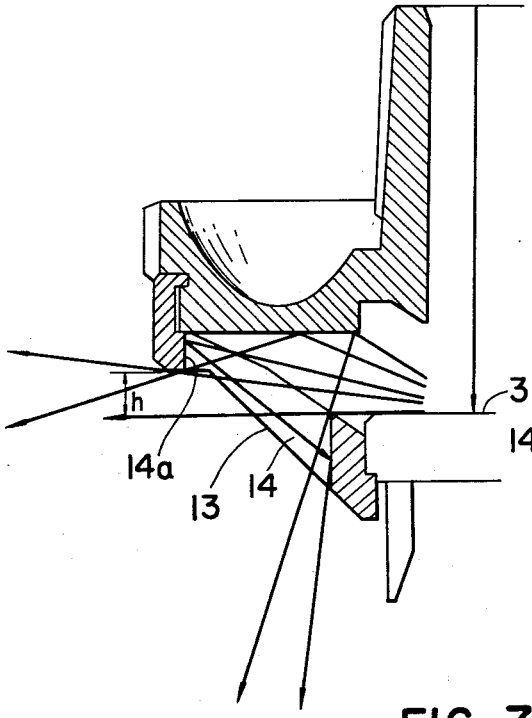
FIG. 8 is a partial sectional view of the sprinkler showing the state of water deflection in operation thereof.

At the same time, another portion of the water deflected by the deflector member 3 again impinges upon the underside of the cover member 2 to be scattered in directions downwardly and obliquely as shown in FIG. 8.

Further, another portion of the water deflected by the deflector member 3 impinges on the outer portion 14*a* of the peripheral wall 14 of the sprinkling aperture 13 which is disposed perpendicularly to the floor surface over which the water is to be sprinkled. Therefore, such portion of water flows along the peripheral wall 14 in opposite directions inwardly of the sprinkler in order to be spouted out toward a relatively wide area including a position immediately below the sprinkler.

It is to be understood that the respective portions of water deflected by the deflector member 3 do not behave independently of each other, but present a more complicated reaction due to interactions between the respective streams of water scattered under a high pressure.

Figure 9:
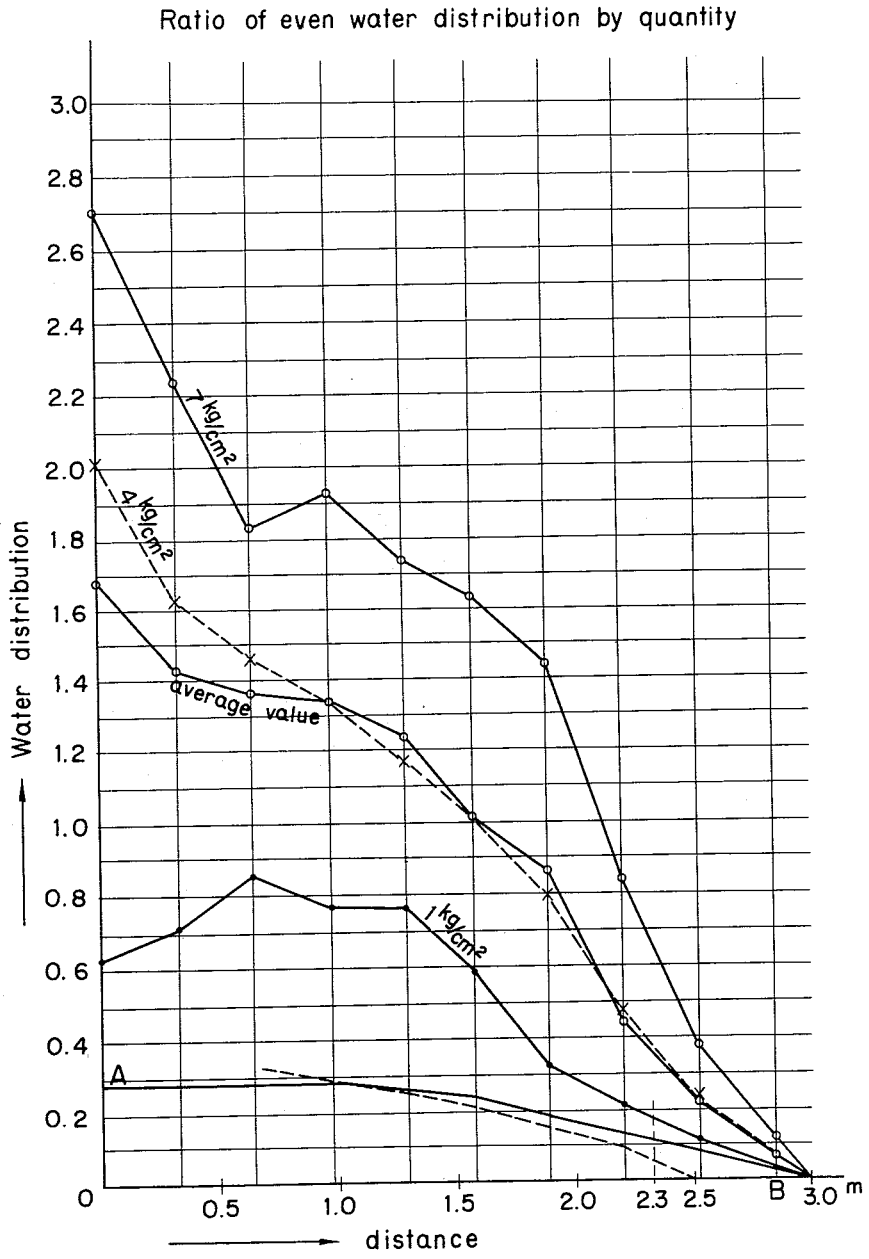
FIG. 9 is a graphical representation of the water sprinkling distribution tests of the sprinkler.

Furthermore, the results of water sprinkling distribution tests of the sprinkler according to the present invention will be given by way of a graphical representation as shown in FIG. 9.

In the tests, eight rows of liquid measuring cups comprising 10 each in a row were placed on the floor in a circle of 300cm radius from the center of a sprinkler head which was placed at the height of approximately 120cm from the top surface of the measures and the hydraulic pressure was changed to 1, 4 and 7kg/cm$^2$, respectively.

The test results showed that the quantity of sprinkled water fell in the region above the specified water sprinkling distribution curves A and B shown in FIG. 9 and that the sprinkler according to this invention could meet all the legal requirements that more than 60% of water discharged shall be sprinkled within the range of 300cm from the axis of the sprinkler head and that the difference in the quantity of water caught in the respective measures shall be kept to a minimum.

In the aforementioned description, it should be understood that the expression "in parallel to the floor surface" does not always apply to a relation to an actual floor surface, but it means a theoretical surface over which the water is to be sprinkled. Therefore, if the sprinkler is mounted on a slanted ceiling surface (for example, a ceiling beneath a staircase or escalator), a theoretical floor surface in parallel to the surface of such a ceiling is meant by this expression.

As fully stated hereinbefore, the sprinkler according to this invention provides a sprinkling of a sufficient quantity of water more than the legally specified level over a circular range within 3 meters from the position directly below the sprinkler even in the presence of pressure variations. Further, the sprinkler according to the invention has a simple construction which can be manufactured in a relatively easy manner comprising cutting circular apertures which do not require a complicated operation such as the provision of spiral grooves or a plurality of small apertures.

What is claimed is:

1. An improved sprinkler head, comprising:

a funnel-shaped housing member provided at its upper end with an annular internally threaded flange, and at its lower end with a central bore which is substantially aligned with the longitudinal axis of the funnel-shaped housing member, said housing member also including a conical wall which slants inwardly and downwardly as it extends between the annular flange and said central bore, said conical wall having a plurality of sprinkling apertures extending therethrough;

a threaded disc-shaped cover threadably engaged within the annular flange, said cover having a pipe portion fixed centrally thereto and projecting upwardly therefrom, said cover having a substantially flat bottom surface which extends substantially perpendicular to said longitudinal axis and is spaced upwardly above the interior surface of said conical wall;

a deflector mounted on said housing member and positioned below said cover, said deflector having an upper platelike portion normally maintained in sealed engagement with said cover in surrounding relationship to the discharge end of said pipe portion;

means coacting between said housing member and said deflector for normally maintaining said platelike portion in sealed engagement with said cover, said means including a fusable portion which melts in response to a preselected temperature for permitting the deflector to be moved downwardly into a lowered position out of sealed engagement with said cover;

the improvement wherein each sprinkling aperture is defined by a peripheral wall which extends substantially perpendicular to the flat bottom surface of said cover, whereby said peripheral wall has an axial direction which is substantially parallel to the longitudinal axis of said housing member, and at least a portion of said peripheral wall as disposed radially outermost from said longitudinal axis being positioned at an elevation between the bottom surface of said cover and the upper surface of said platelike portion when the latter is in said lowered position, whereby at least part of the liquid supplied through said pipe portion impinges against the upper surface of said deflector and is deflected radially outwardly and impinges against the outer portion of said peripheral wall.

2. A sprinkler head according to claim 1, wherein the lowermost edge of the outer portion of said peripheral wall is at an elevation above the upper surface of said platelike portion when the deflector is in said lowered position.

3. A sprinkler head according to claim 2, wherein the upper surface of said platelike portion, when the deflector is in said lowered position, is at an elevation substantially the same as the upper edge of that portion of the peripheral wall which is radially closest to said longitudinal axis.

4. A sprinkler head according to claim 3, wherein the upper surface of said platelike portion, when in its upper position wherein it sealingly engages the cover, is at an elevation which is substantially the same as the upper edge of the outer portion of said peripheral wall.

5. A sprinkler head according to claim 1, wherein the conical wall gradually increases in thickness from the periphery of the housing member to its center, to provide the sprinkling apertures with walls which are thicker at their portions closer to the center of the housing than those portions closer to the periphery of the housing.

* * * * *